US008025377B2

(12) United States Patent
Wu et al.

(10) Patent No.: US 8,025,377 B2
(45) Date of Patent: Sep. 27, 2011

(54) INK CARTRIDGE

(75) Inventors: Chia-Fu Wu, Tainan (TW); Francis Chee-Shuen Lee, Hsinchu (TW); Shih-Chieh Yeh, Tainan (TW)

(73) Assignee: International United Technology Co., Ltd., Hsin-Chu (TW)

( * ) Notice: Subject to any disclaimer, the term of this patent is extended or adjusted under 35 U.S.C. 154(b) by 1176 days.

(21) Appl. No.: 11/745,467

(22) Filed: May 8, 2007

(65) Prior Publication Data

US 2007/0268345 A1 Nov. 22, 2007

(30) Foreign Application Priority Data

May 19, 2006 (TW) ..... 95117816 A

(51) Int. Cl.

| | |
|---|---|
| ***B41J 2/175*** | (2006.01) |
| ***B41J 29/393*** | (2006.01) |
| ***B41J 2/14*** | (2006.01) |
| ***B41J 2/17*** | (2006.01) |

(52) U.S. Cl. ..... 347/86; 347/19; 347/49; 347/84; 347/85; 347/87

(58) Field of Classification Search ..... 347/19, 347/49, 84–87

See application file for complete search history.

(56) References Cited

U.S. PATENT DOCUMENTS

| | | | | |
|---|---|---|---|---|
| 5,497,178 | A * | 3/1996 | DeFosse et al. | 347/87 |
| 5,576,750 | A | 11/1996 | Brandon et al. | |
| 5,926,195 | A | 7/1999 | Domhoff et al. | |
| 6,260,961 | B1 | 7/2001 | Seu et al. | |
| 6,290,348 | B1 * | 9/2001 | Becker et al. | 347/87 |
| 6,293,664 | B1 | 9/2001 | DeFosse et al. | |
| 6,409,324 | B1 | 6/2002 | Hsu et al. | |
| 2002/0122103 | A1 * | 9/2002 | Yamamoto et al. | 347/85 |
| 2004/0100540 | A1 * | 5/2004 | Hatasa et al. | 347/86 |
| 2004/0150700 | A1 * | 8/2004 | Lo et al. | 347/86 |

FOREIGN PATENT DOCUMENTS

| | | |
|---|---|---|
| EP | 261764 | 3/1988 |
| JP | 9-267487 | 10/1997 |
| JP | 11-240182 | 9/1999 |
| TW | I259806 | 8/2006 |
| WO | 01/49497 | 7/2001 |

* cited by examiner

*Primary Examiner* — Charlie Peng
*Assistant Examiner* — Hung Lam
(74) *Attorney, Agent, or Firm* — Jianq Chyun IP Office

(57) ABSTRACT

An ink cartridge is provided with a body, a channel module attached to the body, a plurality of first engaging parts, and a plurality of second engaging parts. The first engaging parts are arranged on one of the body and the channel module, while the second engaging parts corresponding to the first engaging parts are arranged on the other of the body and the channel module. The relative position of the body and the channel module on a two-dimension plane is substantially fixed by the engagement of the first engaging parts and the second engaging parts.

11 Claims, 14 Drawing Sheets

400

INK CARTRIDGE

CROSS-REFERENCE TO RELATED APPLICATION

This application claims the priority benefit of Taiwan application serial no. 95117816, filed May 19, 2006. All disclosure of the Taiwan application is incorporated herein by reference.

BACKGROUND OF THE INVENTION

1. Field of the Invention

The present invention relates to an ink cartridge. More particularly, the present invention relates to an ink cartridge having flow channels fabricated separately by means of module and then assembled to the body.

2. Description of Related Art

Inkjet printing technique has been widely used in the office equipments having the function of printing graphics. Inkjet printing technique mainly uses a high pressure produced by a printhead (inkjet chip) to push ink instantly. Ink drops are then jetted from the printhead onto a surface of a document so as to form ink dots which form graphics or texts on the surface of the document.

In order to supply ink to the printhead, the ink cartridge has an ink chamber for storing ink and a flow channel for guiding the ink in the ink chamber to the printhead. As for a single ink cartridge supplying multiple colors of ink, the ink of each color has an independent ink chamber and an independent flow channel.

One of the several methods of fabricating cartridges in the conventional arts is to integrate ink chambers and flow channels as a whole by molding, and then sealing one side of the flow channels with a cover plate. However, the mold design of the ink cartridge in such method will be more difficult, resulting in the increase of the fabricating cost of the ink cartridge. The method is disclosed in, for example, U.S. Pat. No. 5,497,178 and U.S. Pat. No. 6,811,250.

Therefore, the Taiwan Patent No. I 259806 entitled "Ink Cartridge" has disclosed a technique of fabricating the ink chambers and the flow channels of the ink cartridge separately and then assembling them, which facilitates reducing the fabricating cost of the ink cartridge.

FIG. 1A is a perspective exploded view of a conventional ink cartridge obtained from a view angle. FIG. 1B is a perspective exploded view of the conventional ink cartridge of FIG. 1A obtained from another view angle. Referring to FIGS. 1A and 1B, the ink cartridge 100 includes a body 110 and a channel module 120. The body 110 has three ink chambers 112*a*, 112*b*, and 112*c* and three ink delivery ports 116*a*, 116*b*, and 116*c*. The ink delivery ports 116*a*, 116*b*, and 116*c* are located at the bottom of the body 110, and the ink chambers 112*a*, 112*b*, and 112*c* respectively fluidly communicate with the ink delivery ports 116*a*, 116*b*, and 116*c*, so that the ink in the ink chambers 112*a*, 112*b*, and 112*c* is supplied to the channel module 120.

The channel module 120 has three flow channels 122*a*, 122*b*, and 122*c*. The ink chambers 112*a*, 112*b*, and 112*c* respectively fluidly communicate to the flow channels 122*a*, 122*b*, and 122*c* by the ink delivery ports 116*a*, 116*b*, and 116*c* on the bottom. The flow channels 122*a*, 122*b*, and 122*c* farther respectively have three ink supply ports 124*a*, 124*b*, and 124*c* in a chip bonding area R, such that the ink is output to the printhead (inkjet chip) on the chip bonding area R.

The channel module 120 is attached to the bottom of the body 110 by means of ultrasonic welding, laser welding, or adhesive coating. No matter before or after the attaching, in order to locate the channel module 120 onto the bottom of the body 110, two blocks 118*a* and 118*b* of the body 110 are respectively engaged with two indentations 128*a* and 128*b* of the channel module 120, such that the channel module 120 is located at the bottom of the body 110.

However, by using the blocks 118*a* and 118*b* and the indentations 128*a* and 128*b* to locate the body 110 and the channel module 120, only one side (adjacent to the left side of FIG. 1B, or referred to as the front end of the channel module 120) of the channel module 120 can be located, and the other side of the channel module 120 (adjacent to the right side of FIG. 1B, or referred to as the back end of the channel module 120) can swing. Therefore, whether the location is accurate after assembling should be inspected by a measurement tool with at least a two-dimensional level. If the swing is serious, the yield of attachment between the channel module 120 and the body 110 is poor. Therefore, in order to prevent the swing of the channel module 120, one method is to fit the blocks 118*a* and 118*b* with the indentations 128*a* and 128*b* by means of interference.

However, when the blocks 118*a* and 118*b* and the indentations 128*a* and 128*b* are fitted by means of interference, stress will be concentrated on a junction between the blocks 118*a* and 118*b* and the indentations 128*a* and 128*b*. If the ultrasonic welding method is used to attach the channel module 120 to the body 110, the ultrasonic energy will be concentrated at the position where stress is concentrated, so the yield of attachment between the channel module 120 and the body 110 is reduced.

SUMMARY OF THE INVENTION

The present invention is directed to an ink cartridge for enhancing the production yield.

The present invention is also directed to an ink cartridge for enhancing the flexibility in arrangement of the ink chambers.

The present invention is also directed to an ink cartridge for conveniently locating the channel module of the ink cartridge to the body of the ink cartridge.

The objectives and advantages of the present invention can be further understood from the technical features disclosed by the present invention.

As embodied and broadly described herein, an ink cartridge including a body, a channel module, first engaging parts, and second engaging parts is provided. The body has ink chambers. The channel module is attached to the body. The first engaging parts are arranged on one of the body and the channel module. The second engaging parts corresponding to the first engaging parts are arranged on the other of the body and the channel module. The relative position of the body and the channel module on a two-dimension plane is substantially fixed by the engagement of the first engaging parts and the second engaging parts.

As embodied and broadly described herein, an ink cartridge including a body and a channel module is provided. The body has ink chambers and ink delivery ports. The ink delivery ports are located at a bottom of the body, and the ink chambers respectively fluidly communicate with the ink delivery ports. The channel module has a base attached to the bottom of the body and an uplift portion protruding from the base, and has a chip bonding area located on the uplift portion, ink supply ports located on the chip bonding area, and flow channels respectively fluidly communicating the ink delivery ports with the ink supply ports. The base has a base surface, and the uplift portion has a side surface connecting the base surface and the chip bonding area. The angle between the side surface and the base surface is between 90 degrees and 135 degrees.

According to the present invention, the relative position of the body and the channel module on a two-dimension plane is fixed by means of engagement, so as to ensure the relative location when and after the channel module is attached to the body. Moreover, in the present invention, the horizontal section of some flow channels extends from the chip bonding area to an area outside the chip bonding area, so as to enhance the flexibility in arrangement of the ink chambers.

In order to obtain the aforementioned and other objectives, features and advantages of the present invention, comprehensible embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 5C' is a perspective exploded view of the ink cartridge according to the fifth embodiment of the present invention obtained from a view angle.

DESCRIPTION OF EMBODIMENTS

The following embodiments are illustrated with reference to the accompanied drawings, so as to illustrate the specific embodiments for implementing the present invention. The direction terms mentioned in the present invention such as "up", "down", "front", "back", "left" and "right" only refer to the directions in the accompanied drawings. Therefore, the direction terms are used for illustrating and not for limiting the present invention.

Figure 1A:
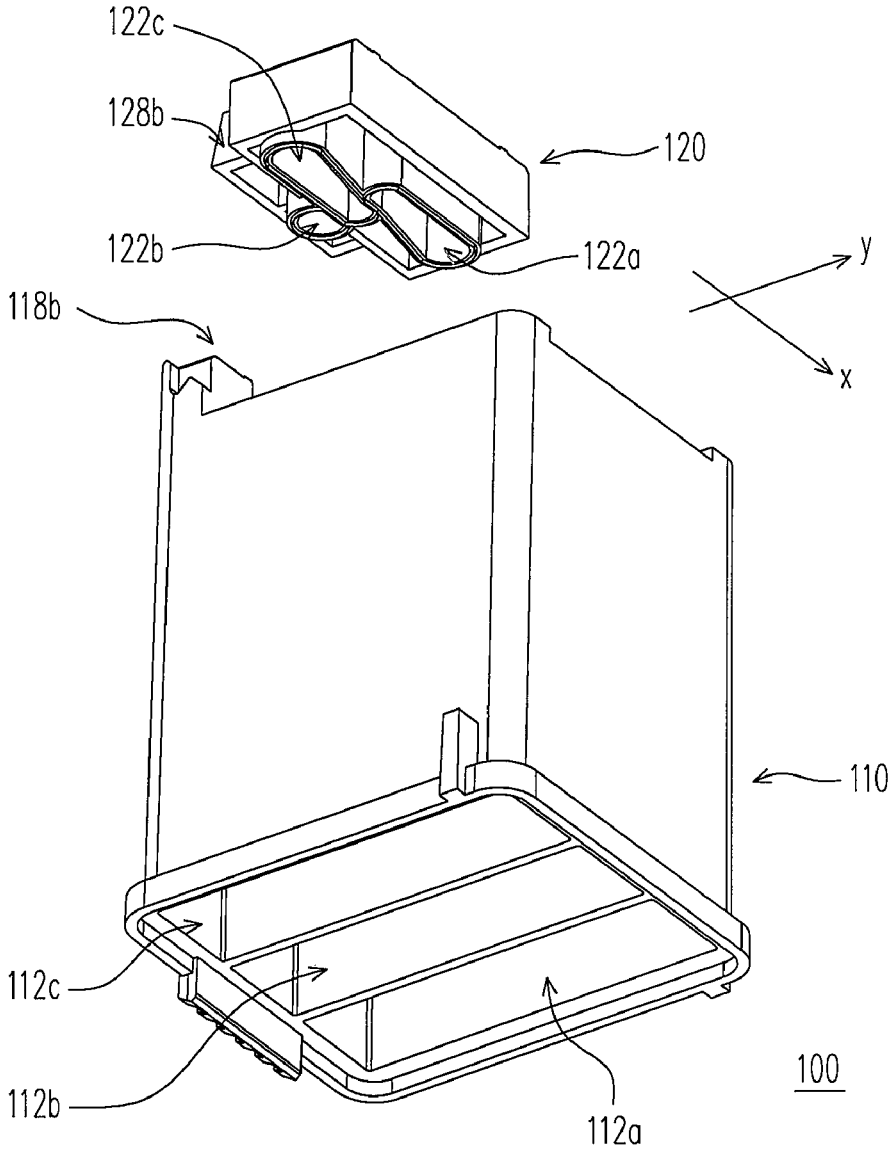
FIG. 1A (PRIOR ART)
FIG. 1A is a perspective exploded view of a conventional ink cartridge obtained from a view angle.
Figure 1B:
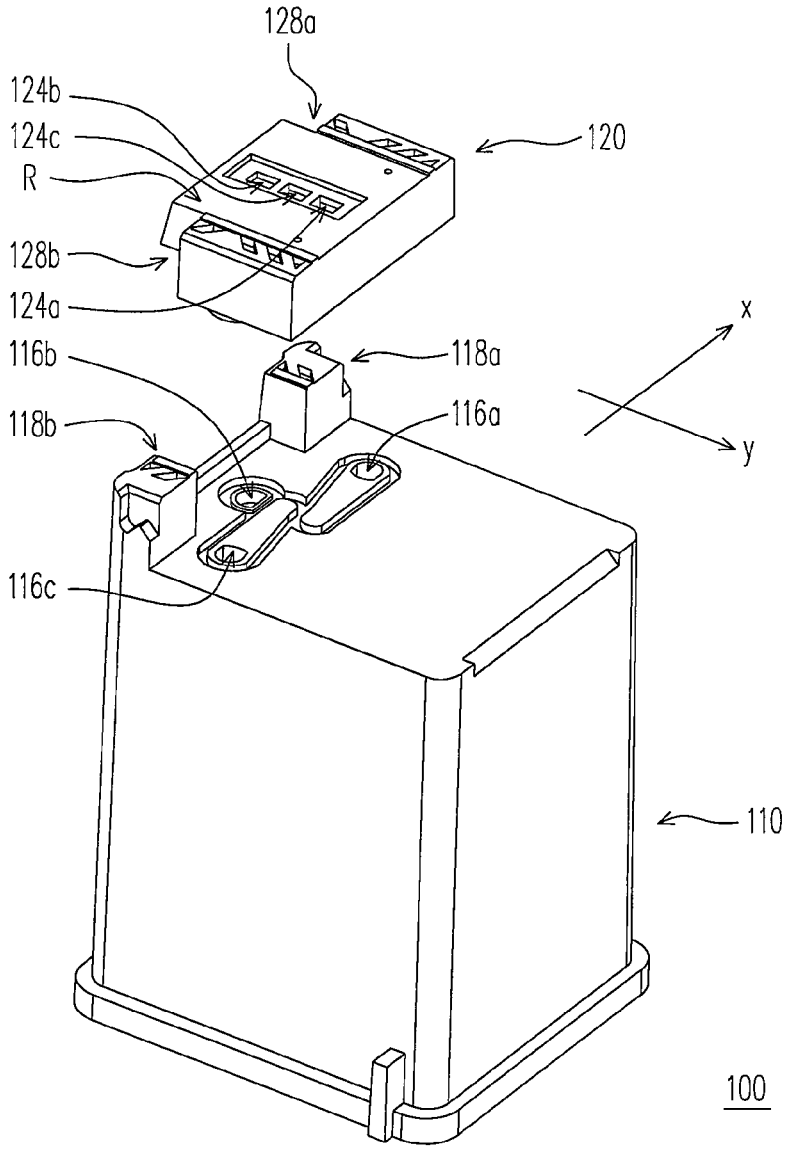
FIG. 1B (PRIOR ART)
FIG. 1B is a perspective exploded view of the ink cartridge of FIG. 1A obtained from another view angle.
Figure 2A:
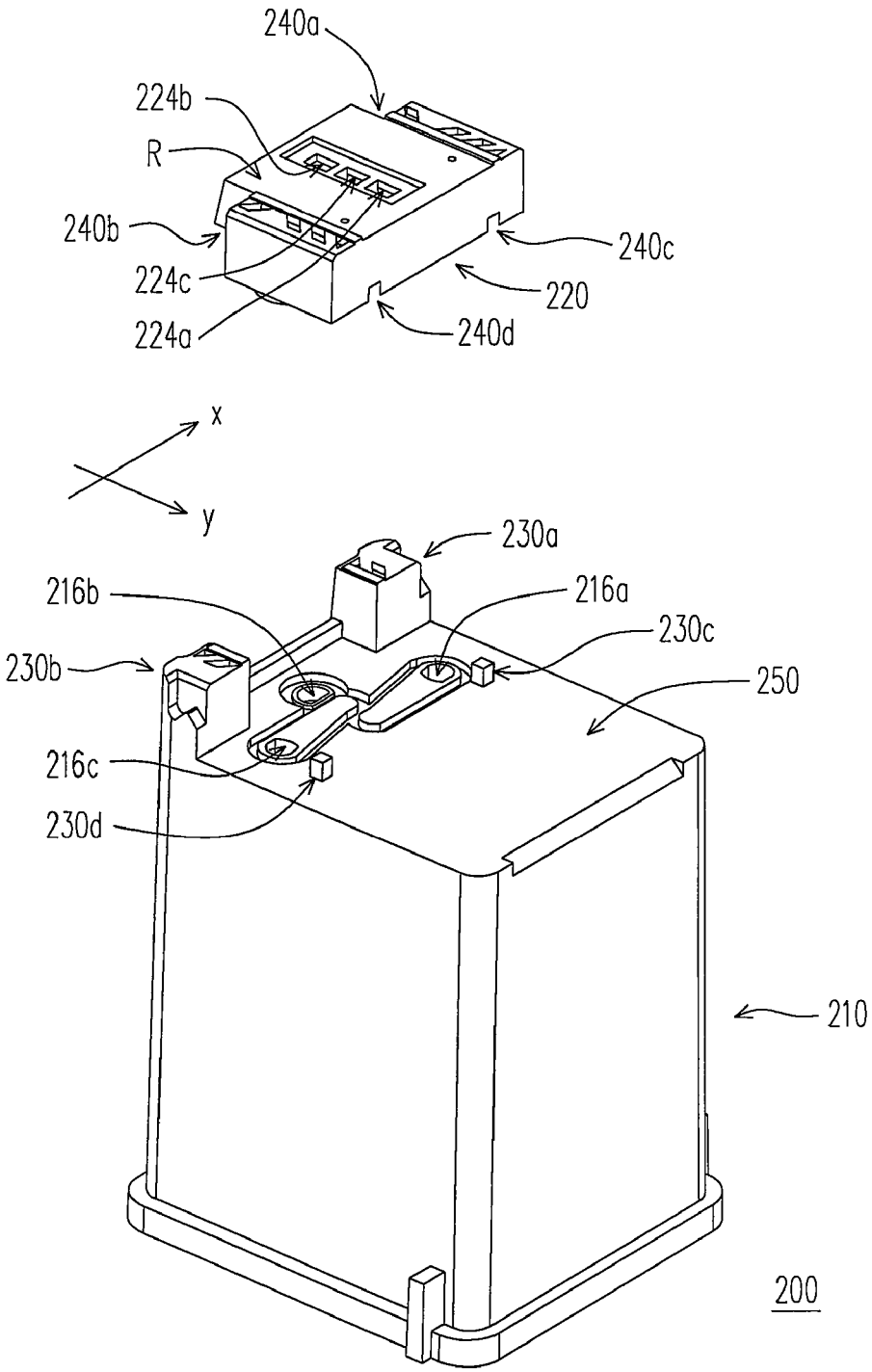
FIG. 2A is a perspective exploded view an ink cartridge according to a first embodiment of the present invention obtained from a view angle.
Figure 2B:
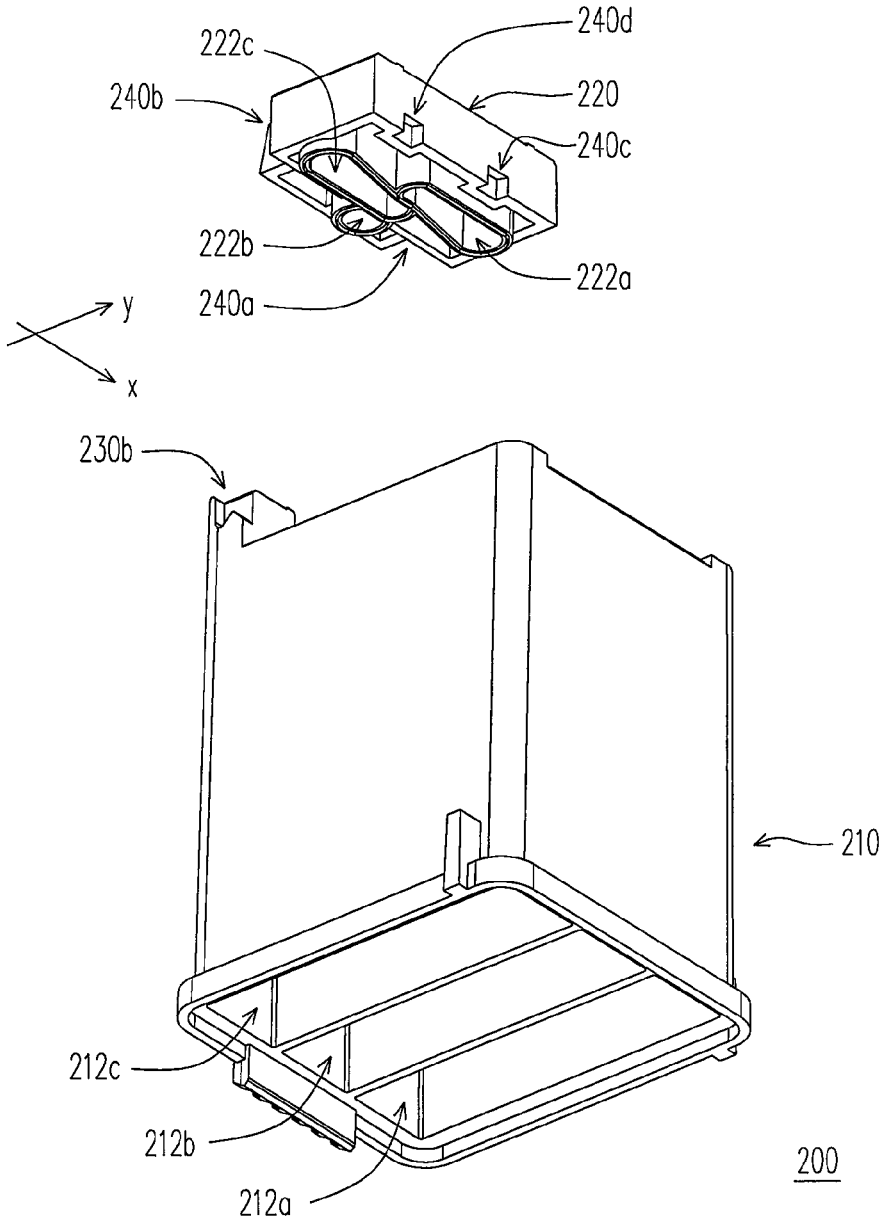
FIG. 2B is a perspective exploded view of the ink cartridge of FIG. 2A obtained from another view angle.

FIG. 2A is a perspective exploded view of an ink cartridge according to a first embodiment of the present invention obtained from a view angle. FIG. 2B is a perspective exploded view of the ink cartridge of FIG. 2A obtained from another view angle. Referring to FIGS. 2A and 2B, the ink cartridge 200 includes a body 210, a channel module 220, engaging parts 230*a* to 230*d*, and engaging parts 240*a* to 240*d*. In one embodiment, the body 210 is a hollow container constituted by a bottom 250 and four sidewalls substantially vertical to the bottom 250.

The body 210 has three ink chambers 212*a* to 212*c* and three ink delivery ports 216*a* to 216*c*. The ink delivery ports 216*a* to 216*c* are respectively located at a bottom 250 of the body 210, and the ink chambers 212*a* to 212*c* respectively fluidly communicate with the ink delivery ports 216*a* to 216*c*.

The channel module 220 has a chip bonding area R, three flow channels 222*a* to 222*c*, and three ink supply ports 224*a* to 224*c*. The ink supply ports 224*a* to 224*c* are located in the chip bonding area R, and the flow channels 222*a* to 222*c* respectively fluidly communicate ink delivery ports 216*a* to 216*c* with the ink supply ports 224*a* to 224*c*.

The engaging parts 230*a* to 230*d* are arranged on the body 210, for example, in the form of the four blocks or protrusions (the blocks and protrusions referred to as blocks in the present invention), and the engaging parts 240*a* to 240*d* are arranged on the channel module 220, for example, in the form of the four indentations or grooves or notches (the indentations or grooves or notches referred to as "indentations" in the present invention) as shown in FIG. 2A. The relative position of the body 210 and the channel module 220 on a two-dimension plane on the surface of the bottom 250 is substantially fixed by the engagement of the engaging parts 230*a* to 230*d* and the engaging parts 240*a* to 240*d*. The two-dimension plane is a plane extended along the x-axis and y-axis in FIGS. 2A and 2B. It should be noted that the term "fixed" in the description of "the relative position of the body and the channel module on a two-dimension plane on the surface of the bottom is substantially fixed" or the like in the embodiments of the present invention includes the meaning of locating the relative position between the channel module and the body.

Compared with the blocks 118*a* and 118*b* of the conventional ink cartridge 100 and the corresponding indentations 128*a* and 128*b* which can only restrict the channel module 120 from moving along the positive x-axis, negative x-axis, and negative y-axis relatively to the body 110, the engaging parts 230*a* to 230*d* and the engaging parts 240*a* to 240*d* of the first embodiment can restrict the channel module 220 from moving along the positive x-axis, negative x-axis, positive y-axis, and negative y-axis relatively to the body 210, and can also restrict the channel module 220 from rotating about the z-axis (orthogonal to the x-axis and y-axis) relatively to the body 210. In other words, not only a deviation of the channel module 220 in x-axis and y-axis directions but also the rotation deviation about the z-axis (orthogonal to the x-axis and y-axis) can be prevented, when the channel module 220 is assembled on the body 210, by the engagement or cooperation of the engaging parts 230*a* to 230*d* and the engaging parts 240*a* to 240*d*.

Since the engaging parts 230*a* to 230*d* and the engaging parts 240*a* to 240*d* are used for locating the relative position between the channel module 220 and the body 210, the accuracy of orientation of the channel module 220 with respect to the body 210 can be improved. Therefore, when the channel module 220 is attached to the body 210, for example, by means of ultrasonic welding, the welding quality and yield can be enhanced because of the engagement of the engaging parts 230*a* to 230*d* and the engaging parts 240*a* to 240*d*. However, the method of fixing the channel module 220 onto the body 210 in the present embodiment is not limited to the ultrasonic welding, other methods such as laser welding, or bonding by adhesive can also be used to fix the channel module 220 onto the body 210. The arrangement of engaging parts in the present invention can assist to locate the channel module 220 onto the body 210. Moreover, by respectively measuring the distance between the engaging parts 230*a* to 230*d* and the distance between the engaging parts 240*a* to 240*d*, the inspector or manufacturer can easily inspect whether the channel module 220 or body 210 is manufactured within an allowable tolerance before fixing the channel module 220 onto the body 210, thereby ensuring that the channel module 220 can be correctly fitted and located on the body 210.

The engaging parts 230*a* to 230*d* are blocks, and the engaging parts 240*a* to 240*d* are indentations. However, in the embodiments which are not shown, one or all of the engaging parts 230*a* to 230*d* is/are indentation(s), and the corresponding one or all of the engaging parts 240*a* to 240*d* is/are block(s). Moreover, in one embodiment, when the engaging parts 230*a* to 230*b* are blocks and are arranged at two corners on one side of the surface of the bottom 250 (as shown for example in FIG. 2A), the engaging parts 230*a* to 230*b* can be used as positioning blocks for positioning or locating the ink cartridge 200 when the ink cartridge 200 is mounted in a printer.

The ink cartridge having three ink chambers is taken as an example. However, it is known that it is not intended to limit the number of the ink chambers of the ink cartridge of the present invention, and persons skilled in the art can determine the number of the ink chambers, for example, two ink chambers or more than four ink chambers according to the spirit of the present invention.

Figure 3A:
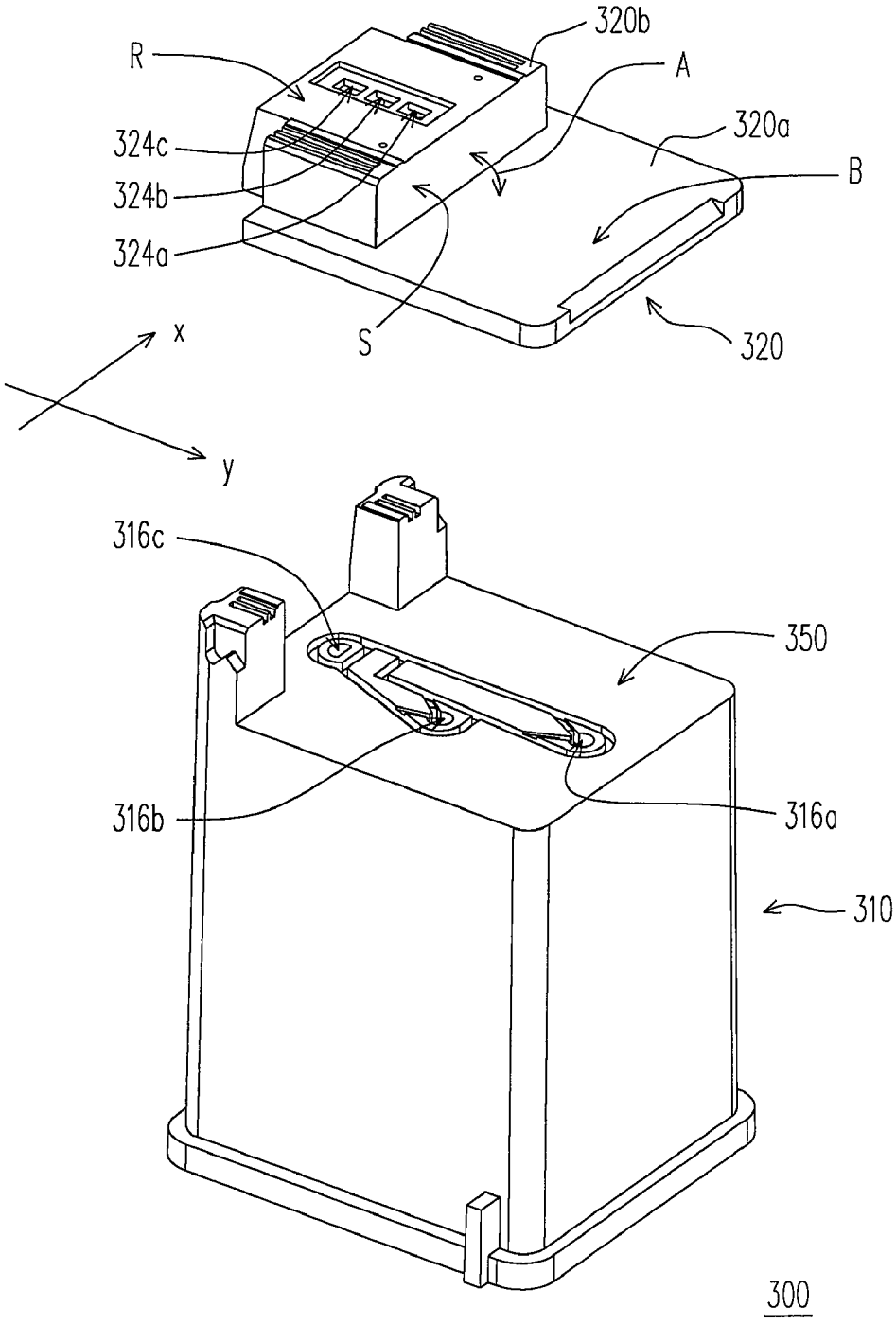
FIG. 3A is a perspective exploded view of an ink cartridge according to a second embodiment of the present invention obtained from a view angle.
Figure 3B:
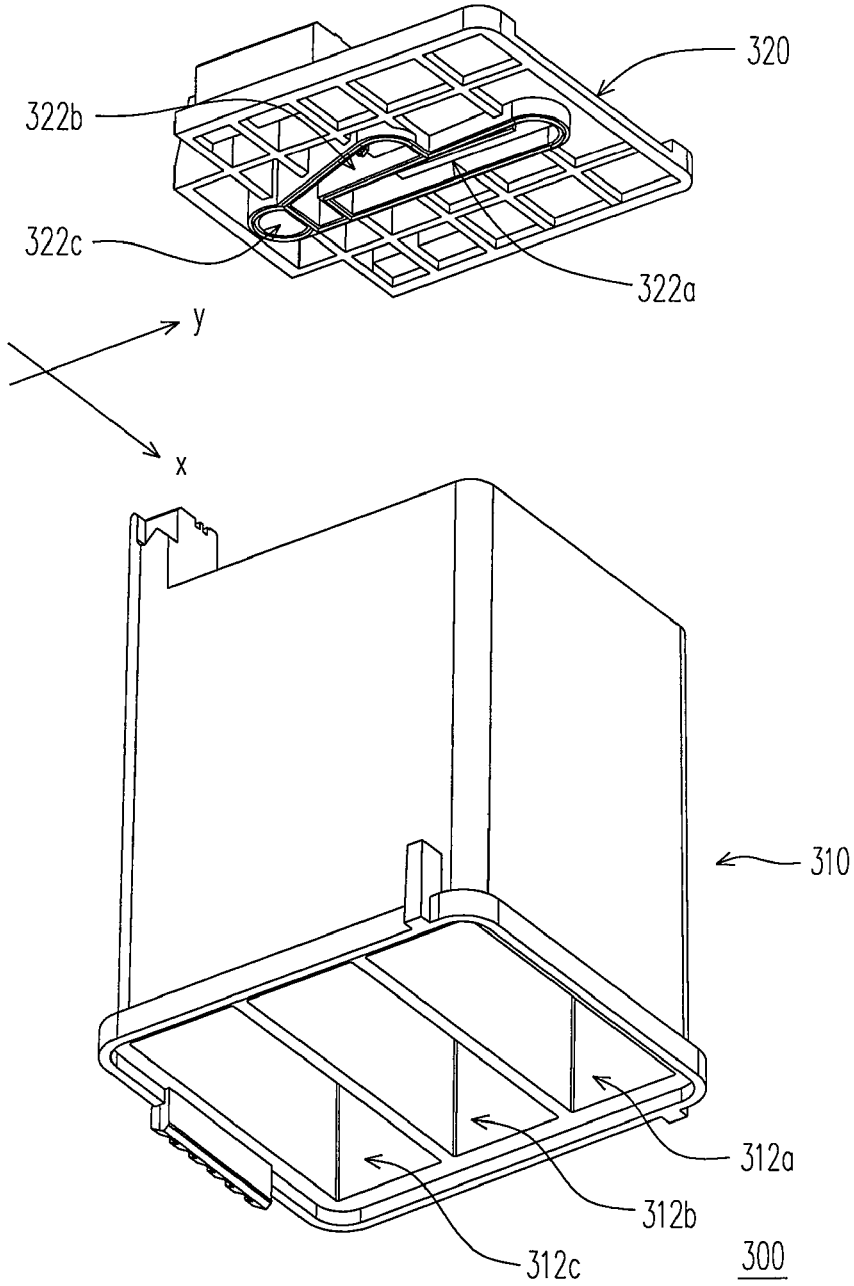
FIG. 3B is a perspective exploded view of the ink cartridge of FIG. 3A obtained from another view angle.

FIG. 3A is a perspective exploded view of an ink cartridge according to a second embodiment of the present invention obtained from a view angle. FIG. 3B is a perspective exploded view of the ink cartridge of FIG. 3A obtained from another view angle. Referring to FIGS. 3A and 3B, the ink cartridge 300 includes a body 310 and a channel module 320.

The body 310 has three ink chambers 312*a* to 312*c* and three ink delivery ports 316*a* to 316*c*. The ink delivery ports 316*a* to 316*c* are located at a bottom 350 of the body 310, and the ink chambers 312*a* to 312*c* respectively fluidly communicate with the ink delivery ports 316*a* to 316*c*.

The channel module 320 is attached to the bottom 350 of the body 310. The channel module 320 has a chip bonding area R, three flow channels 322*a* to 322*c*, and three ink supply ports 324*a* to 324*c*. The ink supply ports 324*a* to 324*c* are located in the chip bonding area R, and the flow channels 322*a* to 322*c* respectively fluidly communicate ink delivery ports 316*a* to 316*c* with the ink supply ports 324*a* to 324*c*.

The channel module 320 has a base 320*a* attached to the body 310, an uplift portion 320*b* protruding from the base 320*a*. The chip bonding area R is formed on the uplift portion 320*b*. The base 320*a* has a base surface B. The uplift portion 320*b* has a side surface S connecting the base surface B and the chip bonding area R, and the angle A between the side surface S and the base surface B is between 90 degrees and 135 degrees.

A section of the flow channel 322*a* substantially parallel to the abovementioned two-dimension plane extends from the chip bonding area R to an area outside the chip bonding area R. Moreover, the ink supply ports 324*a* to 324*c* are arranged in sequence. In one embodiment, the extending direction of the section of the flow channel 322*a* is substantially parallel to the arrangement direction of the ink supply ports 324*a* to 324*c* in the y-axis direction shown in FIGS. 3A and 3B. In another embodiment, the angle between the extending direction of the section of the flow channel 322*a* and the arrangement direction of the ink supply ports 324*a* to 324*c* is greater than 0 degree (i.e. the extending direction of the section of the flow channel 322*a* is not substantially parallel to the arrangement direction of the ink supply ports 324*a* to 324*c*). In other words, the extending direction of the section of the flow channel 322*a* may be designed similar to that of a section of the flow channel 322*b* substantially parallel to the abovementioned two-dimension plane.

In one embodiment, the ink chambers 312*a* to 312*c* are arranged in sequence, and the extending direction of the section of the flow channel 322*a* is substantially parallel to the arrangement direction (y-axis direction) of the ink chambers 312*a* to 312*c*. In other embodiments, the extending direction of the section of the flow channel 322*a* is not required to be substantially parallel to the arrangement direction of the ink chambers 312*a* to 312*c*. In other words, the extending direction of the section of the flow channel 322*a* can be designed similar to that of a section of the flow channel 322*b* substantially parallel to the abovementioned two-dimension plane. Moreover, the ink chambers 312*a* to 312*c* are arranged in sequence, and the ink supply ports 324*a* to 324*c* are arranged in sequence, and the arrangement direction of the ink chambers 312*a* to 312*c* is substantially parallel to the arrangement direction of the ink supply ports 324*a* to 324*c* (y-axis direction).

The ink chambers 312*a* to 312*c* can be arranged along different directions by horizontally extending one, some, or all of the flow channels. Therefore, compared with the ink chambers 212*a* to 212*c* in FIGS. 2A and 2B, the ink chambers 312*a* to 312*c* in FIGS. 3A and 3B can accommodate a sponge with a larger width (in the y-axis direction), such that the ink is supplied normally. It is known to persons skilled in the art that it is allowed to extend one or more flow channels instead of one flow channel as required.

Figure 4A:
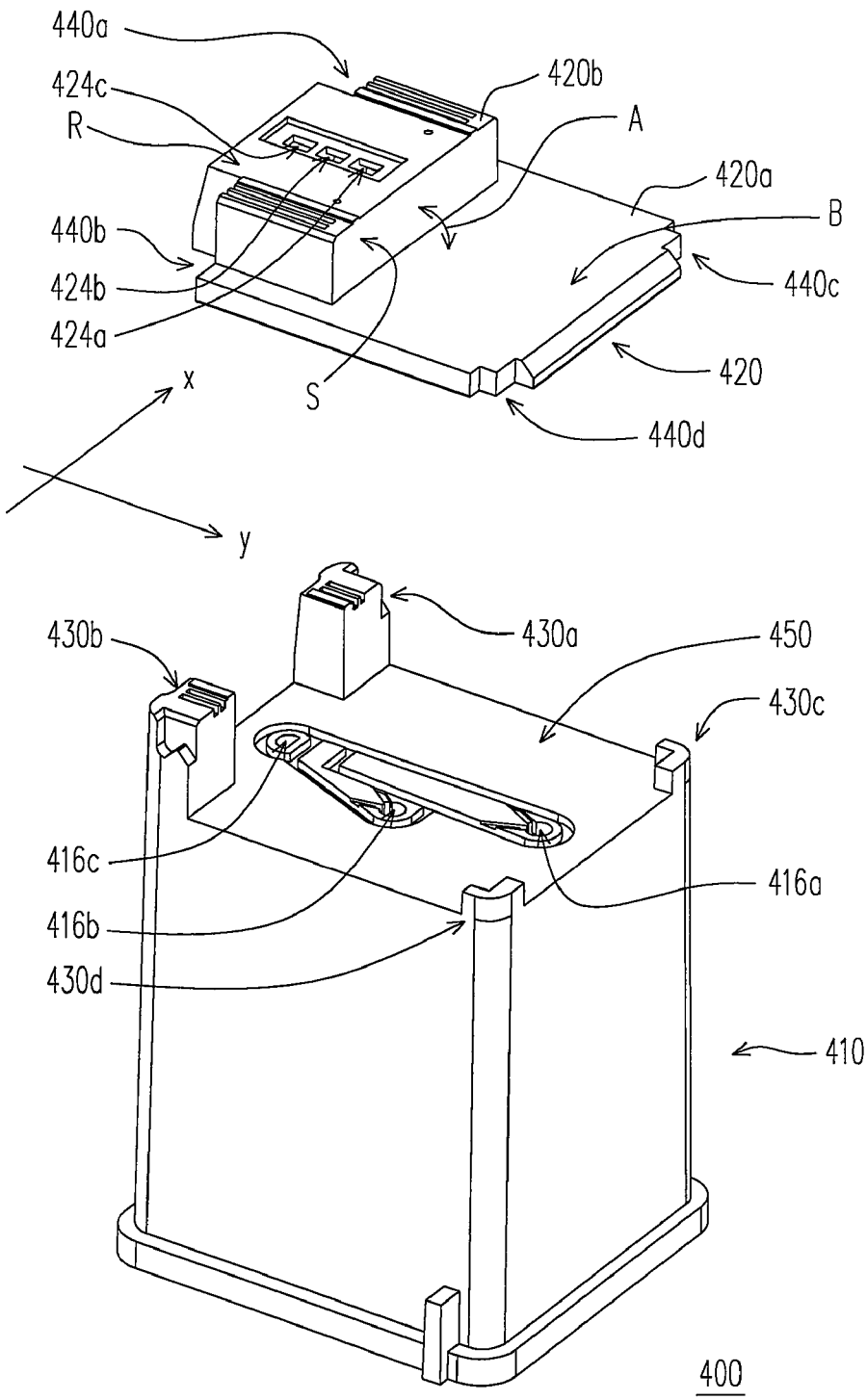
FIG. 4A is a perspective exploded view of an ink cartridge according to a third embodiment of the present invention obtained from a view angle.
Figure 4B:
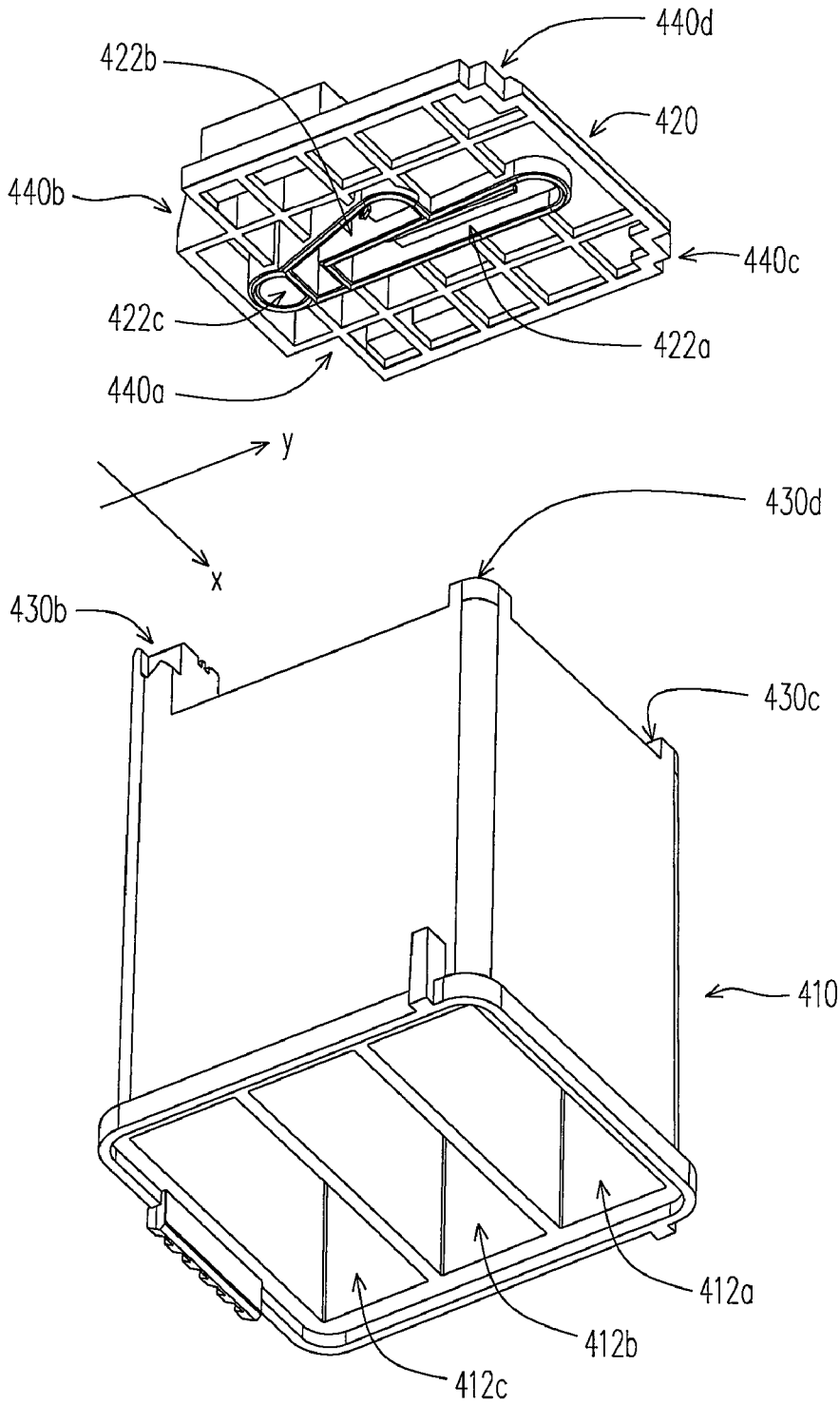
FIG. 4B is a perspective exploded view of the ink cartridge of FIG. 4A obtained from another view angle.

FIG. 4A is a perspective exploded view of an ink cartridge according to a third embodiment of the present invention obtained from a view angle. FIG. 4B is a perspective exploded view of the ink cartridge of the present invention in FIG. 4A obtained from another view angle. The third embodiment is a combination of the first and second embodiments. The ink cartridge 400 includes a body 410, a channel module 420, engaging parts 430*a* to 430*d*, and engaging parts 440*a* to 440*d*.

The body 410 has three ink chambers 412*a* to 412*c* and three ink delivery ports 416*a* to 416*c*. The ink delivery ports 416*a* to 416*c* are respectively located at a bottom 450 of the body 410, and the ink chambers 412*a* to 412*c* respectively fluidly communicate with the ink delivery ports 416*a* to 416*c*.

The channel module 420 includes a chip bonding area R, three flow channels 422*a* to 422*c*, and three ink supply ports 424*a* to 424*c*. The ink supply ports 424*a* to 424*c* are located in the chip bonding area R, and the flow channels 422*a* to 422*c* respectively fluidly communicate ink delivery ports 416*a* to 416*c* with the ink supply ports 424*a* to 424*c*.

The channel module 420 further has a base 420*a* attached to the body 410 and an uplift portion 420*b* protruding from the base 420*a*. The chip bonding area R is formed on the uplift portion 420*b*. The base 420*a* has a base surface B. The uplift portion 420*b* has a side surface S connecting the base surface B and the chip bonding area R, and the angle A between the side surface S and the base surface B is between 90 degrees and 135 degrees.

The engaging parts 430*a* to 430*d* may be arranged on the body 410 in the form of four blocks as shown in FIG. 4A, and the engaging parts 440*a* to 440*d* may be arranged on the channel module 420 in the form of four indentations as shown in FIG. 4A. The relative position of the body 410 and the channel module 420 on a two-dimension plane is substantially fixed by the engagement of the engaging parts 430*a* to 430*d* and the engaging parts 440*a* to 440*d*. The two-dimension plane is a plane extended along the x-axis and y-axis in FIGS. 2A and 2B. By the engagement of the engaging parts 430*a* to 430*d* and the engaging parts 440*a* to 440*d*, the movement of the channel module 420 along the positive x-axis, negative x-axis, positive x-axis, and negative y-axis relatively to the body 410 can be restricted, and the rotation of the channel module 420 about the z-axis (orthogonal to the x-axis and y-axis) relatively to the body 410 can also be restricted. In other words, not only a deviation of the channel module 420 in x-axis and y-axis directions but also the rotation deviation about the z-axis (orthogonal to the x-axis and y-axis) can be prevented, when the channel module 420 is assembled onto the body 410 by the engagement or cooperation of engaging parts 430*a* to 430*d* and the engaging parts 440*a* to 440*d*.

In one embodiment, the engaging parts 430*a* to 430*d* are respectively arranged at the four corners on the surface of the bottom 450, as shown in FIG. 4A. The engaging parts 430*a* to 430*d* when arranged at two corners on the bottom 450 can provide protection for the channel module 420 fixed on the bottom 450, such that the damage to the channel module 420 or separation of the channel module 420 from the body 410, caused by the collision of the channel module 420 when the ink cartridge 400 falls onto the floor, can be avoided.

Since the engaging part 430*a* to 430*d* and the engaging parts 440*a* to 440*d* are used for locating the relative position between the channel module 420 and the body 410, the accuracy of orientation of the channel module 420 with respect to the body 410 can be improved. Therefore, when the channel module 420 is attached to the body 410, for example, by means of ultrasonic welding, the welding quality and yield can be enhanced. However, the engaging method of fixing the channel module 420 onto the body 410 in the present embodiment is not limited to the ultrasonic welding, other methods such as laser welding, or bonding by adhesive can also be used to fix the channel module 420 onto the body 410. The arrangement of engaging parts in the present invention can assist to locate the channel module 420 onto the body 410.

The engaging parts 430*a* to 430*d* are blocks, and the engaging parts 440*a* to 440*d* are indentations. However, in the embodiments which are not shown, one or all of the engaging parts 430*a* to 430*d* is/are indentation(s), and the corresponding one or all of the engaging parts 440*a* to 440*d* is/are block(s). Moreover, in one embodiment, when the engaging parts 430*a* to 430*d* are blocks and arranged at two corners on one side of the surface of the bottom 450 (as shown for example in FIG. 4A), the engaging parts 430*a* and 430*b* can be used as positioning blocks for positioning or locating the ink cartridge 400 when the ink cartridge 400 is mounted in a printer.

The section of the flow channel 422*a* substantially parallel to the abovementioned two-dimension plane extends from the chip bonding area R to an area outside the chip bonding area R. Moreover, the ink supply ports 424*a* to 424*c* are arranged in sequence, and the extending direction of the section of the flow channel 422*a* is substantially parallel to the arrangement direction of the ink supply ports 424*a* to 424*c*, i.e., in y-axis direction in FIGS. 4A and 4B.

The ink chambers 412*a* to 412*c* are arranged in sequence, and the extending direction of the section of the flow channel 422*a* is substantially parallel to the arrangement direction of the ink chambers 412*a* to 412*c* (y-axis direction). Moreover, the ink supply ports 424*a* to 424*c* are arranged in sequence, and the arrangement direction of the ink chambers 412*a* to 412*c* is substantially parallel to the arrangement direction of the ink supply ports 424*a* to 424*c* (y-axis direction). In other embodiments, the extending direction of the section of the flow channel 422*a* is not substantially parallel to the arrangement direction of the ink chambers 412*a* to 412*c*. In other words, the extending direction of the section of the flow channel 422*a* is designed similar to that of a section of the flow channel 422*b* substantially parallel to the abovementioned two-dimension plane.

The ink chambers 412*a* to 412*c* can be arranged along different directions by horizontally extending one, some, or all of the flow channels. Therefore, compared with the ink chambers 212*a* to 212*c* in FIGS. 2A and 2B, the ink chambers 412*a* to 412*c* can accommodate a sponge with a larger width (in the y-axis direction), such that the ink can be supplied normally. It is known to persons skilled in the art that it is allowed to extend one or more flow channels instead of one flow channel as required.

Figure 5A:
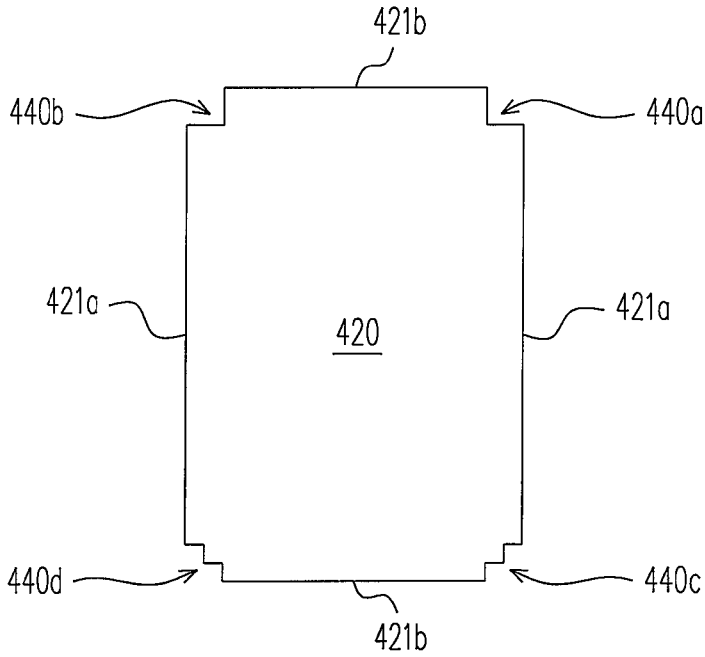
FIG. 5A is a schematic view of a profile of the channel module in FIG. 4A.

FIG. 5A is a schematic view of the profile of the channel module in FIG. 4A. The channel module 420 has two opposite first side edges 421*a* and two opposite second side edges 421*b*, and the four engaging parts 440*a* to 440*d* are respectively located at two ends of each of the two first side edges 421*a*. When the engaging parts 440*a* to 440*d* are indentations, the engaging parts (not shown) corresponding to the engaging parts 440*a* to 440*d* are blocks, and vice versa.

Figure 5B:
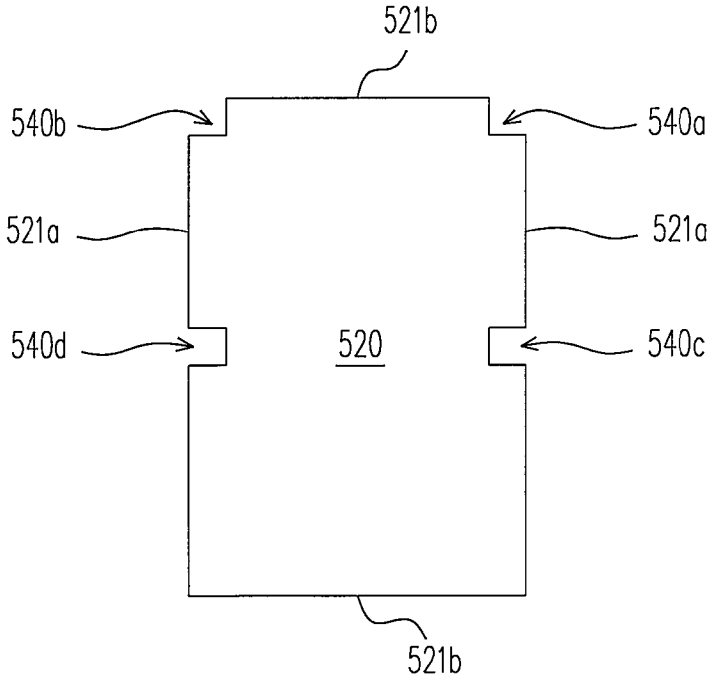
FIG. 5B is a schematic view of a profile of a channel module according to a fourth embodiment of the present invention.

FIG. 5B is a schematic view of the profile of the channel module according to a fourth embodiment of the present invention. The channel module 520 has two opposite first side edges 521*a*, two opposite second side edges 521*b*. Two engaging parts 540*a* to 540*b* respectively located at an end of each of the two first side edges 521*a*, another two engaging parts 540*c* to 540*d* respectively located at the center of each of the two first side edges 521*a*. When the engaging parts 540*a* to 540*d* are indentations, the engaging parts on the body (not shown) corresponding to the engaging parts 540*a* to 540*d* are blocks, and vice versa. It should be noted that the engaging parts 540*c* and 540*d* are not required to be located in the center of each of the two side edges 521*a* respectively, but can also be located between the center and the ends of each of the two first side edges 521*a*.

Figure 5C:
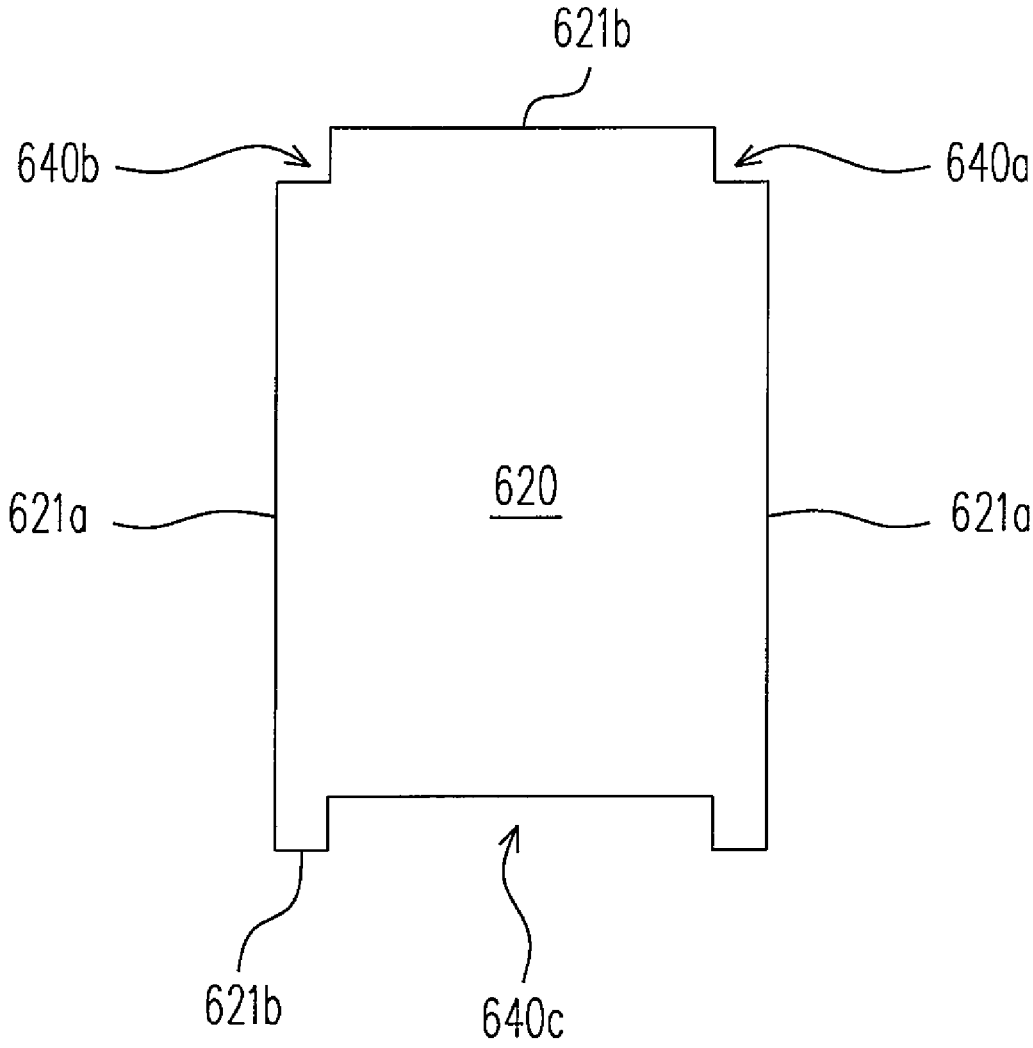
FIG. 5C is a schematic view of a profile of a channel module according to a fifth embodiment of the present invention.
Figure 5C:
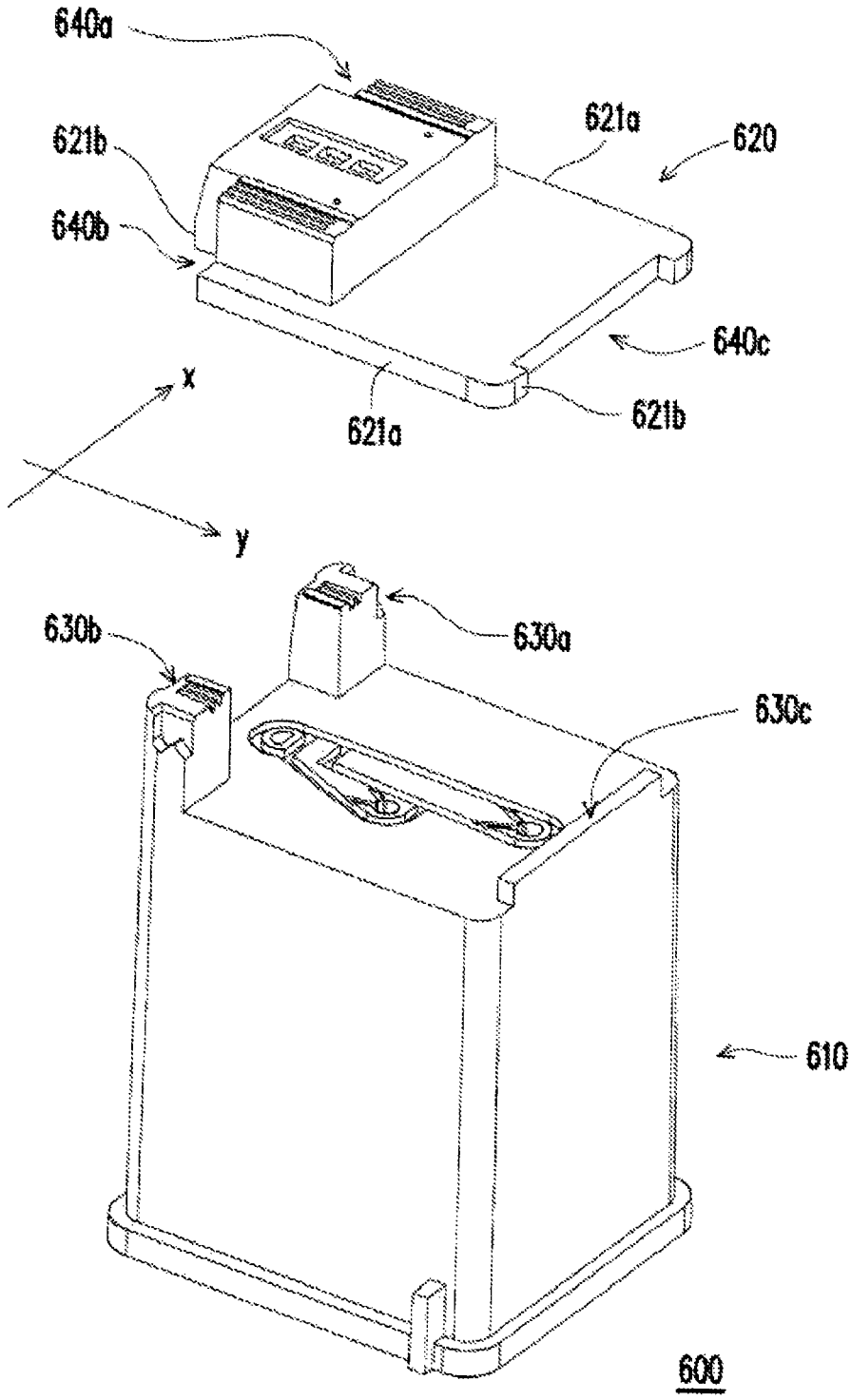

FIG. 5C is a schematic view of the profile of the channel module according to a fifth embodiment of the present invention, and FIG. 5C' is a perspective exploded view of the ink cartridge according to the fifth embodiment of the present invention obtained from a view angle. Referring FIG. 5C and FIG. 5C', the ink cartridge 600 shown in FIG. 5C' has a body 610, a channel module 620, engaging parts 630*a* to 630*c*, and engaging parts 640*a* to 640*c*. The channel module 620 has two opposite first side edges 621*a*, and two opposite second side edges 621*b*. The two engaging parts 640*a* to 640*b* are respectively located at an end of each of the two first side edges 621*a*, and the other engaging part 640*c* is located at the center of the second side edges 621*b* away from the abovementioned ends of the two first side edges where the two engaging parts 640*a* to 640*b* are respectively located. When the engaging parts 640*a* to 640*c* are indentations or recesses, the engaging parts 630*a* to 630*c* on the body 610 corresponding to the engaging parts 640*a* to 640*c* are blocks, and vice versa.

It can be known from the embodiments in FIGS. 5A to 5C that in the scope of the present invention, the number of the above engaging parts on the channel module and the body are determined according to the design requirement, and are respectively located at the corresponding position of the body and the channel module, so as to fix the relative position of the body and the channel module on the two-dimension plane. Moreover, the location of the engaging part on the channel module is not limited to any one side edge of the channel module, and can also be formed on the lower surface of the channel module attached to the bottom of the body.

Figure 6:
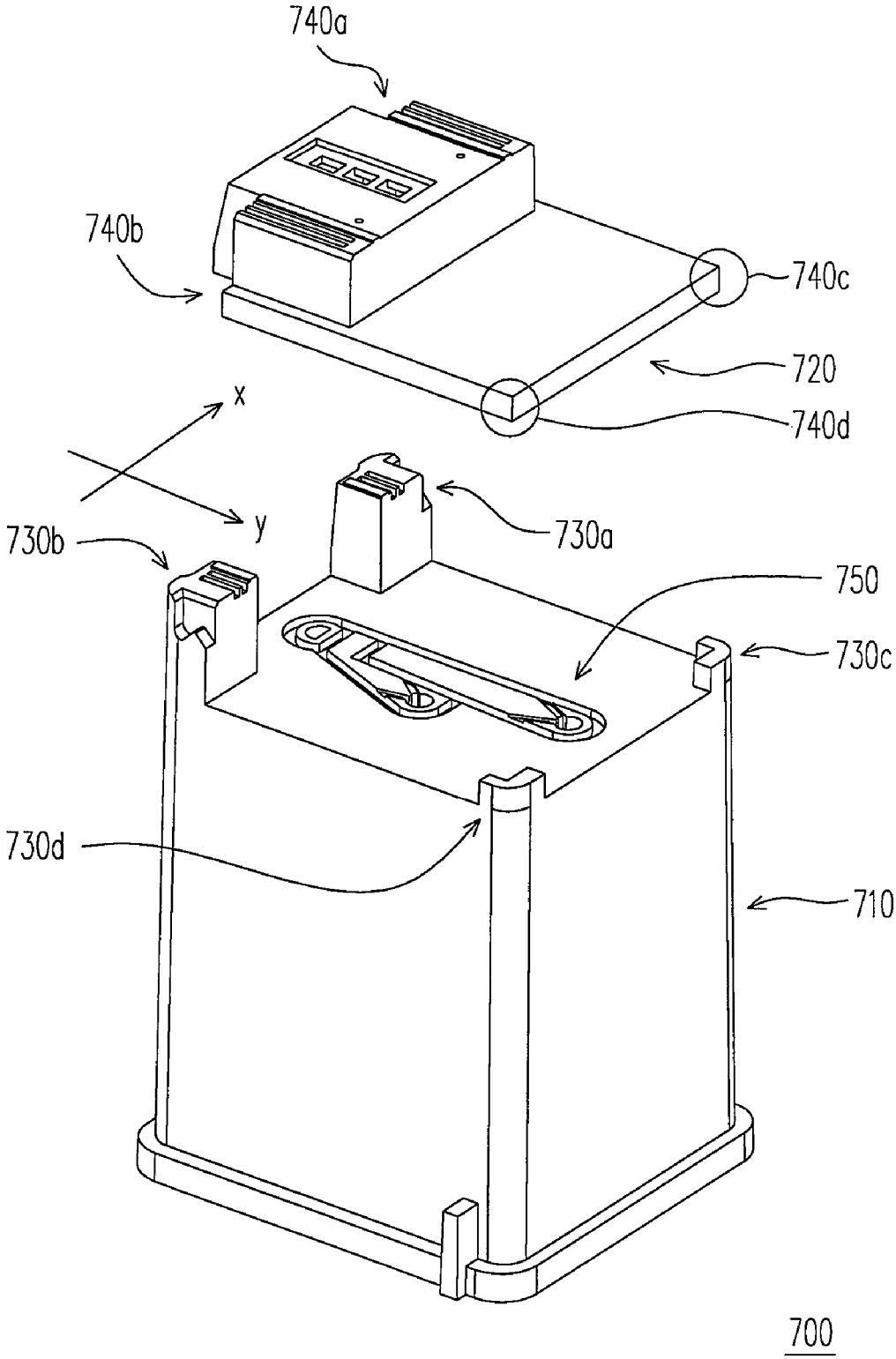
FIG. 6 is a perspective exploded view of an ink cartridge according to a sixth embodiment of the present invention.

FIG. 6 is a perspective exploded view of an ink cartridge according to a sixth embodiment of the present invention. Referring to FIG. 6, in the sixth embodiment, engaging parts 730*a* to 730*d* are at four corners of the external surface of the bottom 750 of the body 710 of the ink cartridge 700, and are engaged with the engaging parts 740*a* to 740*d* at four corners of the channel module 720. Compared with the ink cartridge 400 in the third embodiment of FIG. 4A, the engaging parts 730*c* and 730*d* of the ink cartridge 700 are indentations instead, and the engaging parts 740*c* and 740*d* thereof are blocks instead.

Figure 7:
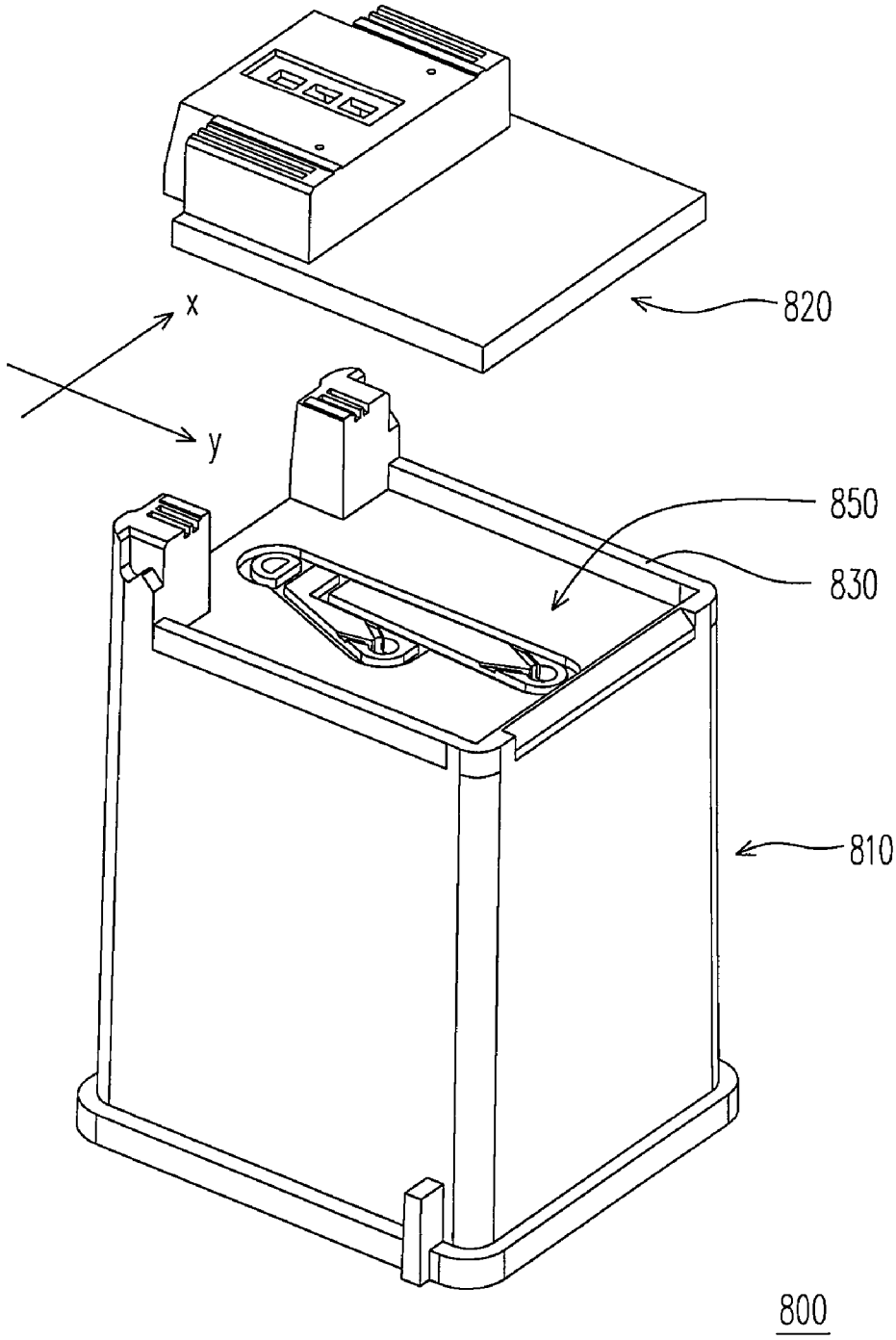
FIG. 7 is a perspective exploded view of an ink cartridge according to a seventh embodiment of the present invention.

FIG. 7 is a perspective exploded view of an ink cartridge according to a seventh embodiment of the present invention. Referring to FIG. 7, compared with the ink cartridge 700 in the sixth embodiment of FIG. 6, an engaging part 830 is on the external surface of the bottom 850 of the body 810 of the ink cartridge 800 in the seventh embodiment and partially surrounds the side edges of the channel module 820, such that the relative position of the body 810 and the channel module 820 on a two-dimension plane (XY plane) is substantially fixed by the engagement of the engaging part 830 and the channel module 820.

Figure 8:
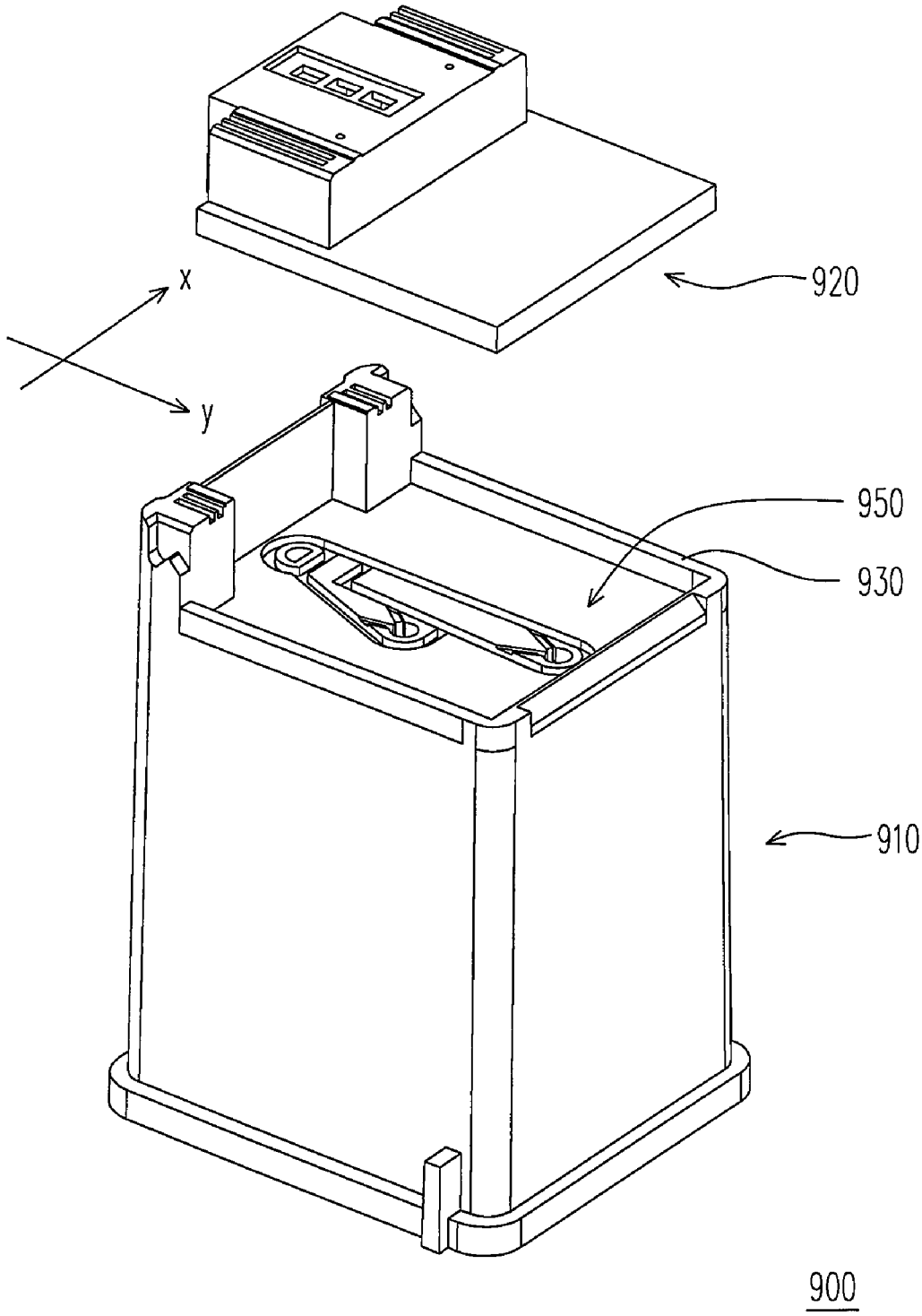
FIG. 8 is a perspective exploded view of an ink cartridge according to an eighth embodiment of the present invention.

FIG. 8 is a perspective exploded view of an ink cartridge according to an eighth embodiment of the present invention. Referring to FIG. 8, compared with the ink cartridge 700 in the seventh embodiment of FIG. 6, an engaging part 930 is arranged on the external surface of the bottom 950 of the body 910 of the ink cartridge 900 in the eighth embodiment and fully surrounds the side edges of the channel module 920, such that the relative position of the body 910 and the channel module 920 on a two-dimension plane (XY plane) is substantially fixed by the engagement of the engaging part 930 and the channel module 920.

In view of the above, the ink cartridge of the present invention uses the engagement to ensure the accuracy and liability of the location between the body and the channel module. On the other hand, in the present invention, the horizontal section of some flow channels extend from the chip bonding area to an area outside the chip bonding area, thereby improving the flexibility in arrangement of the ink chambers.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, the abstract and the title are used to facilitate searching the patent document, but not used for limiting the claimed scope of the present invention.

What is claimed is:

1. An ink cartridge, comprising:

a body, having a plurality of ink chambers for storing ink, the body having a first sidewall, a second sidewall opposite to the first sidewall, a third sidewall, a fourth sidewall opposite to the third sidewall, and a bottom;

a channel module, attached to the bottom of the body;

a plurality of first engaging parts, comprising a first pair of first engaging parts, the first pair of first engaging parts being respectively arranged at the two corners of the external surface of the bottom of the body and adjacent to the first sidewall; and a plurality of second engaging parts, comprising a first pair of second engaging parts, the first pair of second engaging parts being respectively arranged at two corners of the channel module and corresponding to the first pair of first engaging parts, wherein the relative position of the body and the channel module on a two-dimension plane is substantially fixed by the engagement of the first engaging parts and the second engaging parts, the first engaging parts further comprise a second pair of first engaging parts, and the second pair of first engaging parts are arranged on the external surface of the bottom of the body and are arranged in a way substantially parallel to and away from the first sidewall, and the second engaging parts further comprise a second pair of second engaging parts, and the second pair of second engaging parts are arranged on the channel module and are respectively arranged corresponding to the second pair of first engaging parts so as to respectively engage with the second pair of first engaging parts.

2. The ink cartridge as claimed in claim 1, wherein one of the first engaging parts and the corresponding one of the second engaging parts are a block and an indentation.

3. The ink cartridge as claimed in claim 1, wherein the bottom of the body has a plurality of ink delivery ports respectively fluidly communicating with the ink chambers; the channel module has a chip bonding area, a plurality of ink supply ports, and a plurality of flow channels; and the ink supply ports are located in the chip bonding area, and the flow channels respectively fluidly communicate the ink delivery ports with the ink supply ports.

4. The ink cartridge as claimed in claim 3, wherein a section of at least one flow channel of the flow channels which is substantially parallel to the two-dimension plane extends from the chip bonding area to an area outside the chip bonding area.

5. The ink cartridge as claimed in claim 4, wherein the ink supply ports are arranged in sequence, and the extending direction of the section is substantially parallel to the arrangement direction of the ink supply ports.

6. The ink cartridge as claimed in claim 4, wherein the ink chambers are arranged in sequence, and the extending direction of the section is substantially parallel to the arrangement direction of the ink chambers.

7. The ink cartridge as claimed in claim 3, wherein the ink chambers are arranged in sequence, the ink supply ports are arranged in sequence, and the arrangement direction of the ink chambers is substantially parallel to the arrangement direction of the ink supply ports.

8. The ink cartridge as claimed in claim 1, wherein the channel module has a base attached to the body, an uplift portion protruding from the base, and a chip bonding area located on the uplift portion; the base has a base surface, the uplift portion protrudes from the base surface and has a side surface connecting the base surface and the chip bonding area, and the angle between the side surface and the base surface is between 90 degrees and 135 degrees.

9. The ink cartridge as claimed in claim 1, wherein the channel module has a first edge, a second edge opposite to the first edge, a third edge, and a four edge opposite to the third edge, the first pair of second engaging parts are arranged at the first edge, and the second pair of second engaging parts are arranged at the second edge.

10. The ink cartridge as claimed in claim 1, wherein the second pair of first engaging parts are respectively arranged at the another two corners of the external surface of the bottom of the body and adjacent to the second sidewall; and the second pair of second engaging parts are respectively arranged corresponding to the second pair of first engaging parts and at another two corners of the channel module to respectively engage with the second pair of first engaging parts.

11. An ink cartridge, comprising:

a body, having a plurality of ink chambers for storing ink, the body having a first sidewall, a second sidewall opposite to the first sidewall, a third sidewall, a fourth sidewall opposite to the third sidewall, and a bottom;

a channel module, attached to the bottom of the body;

a plurality of first engaging parts, comprising a first pair of first engaging parts, the first pair of first engaging parts being respectively arranged at the two corners of the external surface of the bottom of the body and adjacent to the first sidewall;

a plurality of second engaging parts, comprising a first pair of second engaging parts, the first pair of second engaging parts being respectively arranged at two corners of the channel module and corresponding to the first pair of first engaging parts, wherein the relative position of the body and the channel module on a two-dimension plane is substantially fixed by the engagement of the first engaging parts and the second engaging parts;

a block, protruding from the external surface of the bottom and being arranged adjacent to the second sidewall, the block being extended parallel to the first sidewall; and a recess, formed on an edge of the channel module and being arranged in a way corresponding to the block so as to engage with the block.

* * * * *